United States Patent [19]

Lindenberger

[11] Patent Number: 4,541,310

[45] Date of Patent: Sep. 17, 1985

[54] MULTIPLE-USE RATCHET TOOL

[76] Inventor: Paul H. Lindenberger, 1241 NW. 190 St., Miami, Fla. 33269

[21] Appl. No.: 636,920

[22] Filed: Aug. 2, 1984

[51] Int. Cl.[4] ..... B25B 13/46

[52] U.S. Cl. ..... 81/60; 81/177.1; 81/177.7

[58] Field of Search ..... 81/177 A, 177 E, 177 N, 81/177 ST, 177 PP, 177.8, 177.9, 60, 61; 145/61 L

[56] References Cited

U.S. PATENT DOCUMENTS

| | | | |
|---|---|---|---|
| 1,000,051 | 8/1911 | Thomson | 145/61 L |
| 1,292,285 | 1/1919 | Fairchild | 81/60 |
| 3,186,009 | 6/1965 | Simmons | 81/177 E |
| 3,342,229 | 9/1967 | Janes | 81/177 ST |
| 4,170,909 | 10/1979 | Wagner | 81/177 ST |

*Primary Examiner*—James L. Jones, Jr.
*Attorney, Agent, or Firm*—John Cyril Malloy

[57] ABSTRACT

A multiple purpose ratchet tool including a reversible, and preferably, lockable ratchet head having an output shaft adapted to receive a tool bit such as a socket or screwdriver blade for use, and also including a mair handle portion and an auxiliary handle portion matable to the main handle portion to form a generally cylindrical grippable handle. The main handle portion is pivotally mounted to the ratchet head about an axis perpendicular to that of the output shaft. Releasable main handle portion locking means may retain the main handle portion generally parallel to the output shaft. However, when the main handle portion locking means is released, the main handle portion may be repositioned at any angle up to and including perpendicularly to the output drive shaft axis. The auxiliary handle portion may be pivotally mounted to either the ratchet head coaxailly with the main handle portion pivot mount, or, to and anywhere along, the length of the main handle portion, and is adapted to be releasably, foldably matable against the main handle portion. When pivoted away from the main handle portion up to and including 90°, the auxiliary handle portion is useful for torque multiplication to the output shaft. Alternately, the main and auxiliary handle portions together may be pivoted up to and including 90° to the axis of the output shaft to provide useful function similar to that of a conventional ratchet handle. A detent may be provided to releasably retain the handle in the perpendicular orientation.

12 Claims, 14 Drawing Figures

MULTIPLE-USE RATCHET TOOL

BACKGROUND OF THE INVENTION

This invention relates generally to manual ratchet tools and, more particularly, to a multiple function, reversible ratchet tool having a variety of modes of use for torque application to a socket, screwdriver bit, or the like.

Manual socket wrenches having reversing ratchet output drive shafts are commonly known. A lever handle is disposed perpendicular to the axis of the ratchet head which includes an output or drive shaft adapted to be matably inserted into various sized sockets for use. Another well known type of ratchet tool is that wherein the handle is coaxially disposed with the output drive shaft. Such a tool is shown in U.S. Pat. No. 3,824,881. However, the former well known tool type is limited to high-torque applications with specific space limitations for use, while the latter tool type is limited in its ability for torque application and it, too, may have space limitations for use.

A type of ratchet attachment for screwdrivers is shown in U S. Pat. No. 928,003, wherein a rather cumbersome handle is pivotally mounted adjacent the ratchet housing which is adapted to receive and hold a conventional screwdriver shaft. At the opposite end of the handle is a perpendicularly disposed grip to be used similar to a brace. In either position of the handle, this tool is complicated to use, with severe space limitations, as well as having a very expensive structure. U.S. Pat. No. 3,288,002 discloses a rathet with handle perpendicularly disposed to the axis of the ratchet, the ratchet having a central hole therethrough adapted to receive polygonal elongated Allen-type wrenches. This invention has very narrow application, however.

Another series of invention discloses a handle pivotally connected to a ratchet head which includes a screwdriver blade as its output shaft. The handle is normally coaxial with the screwdriver blade, but may be pivoted perpendicularly for increased leverage. An early and complex device as such is shown in U.S. Pat. No. 1,239,961.Likewise, the screwdriver in U.S. Pat. No. 1,665,240 teaches a similar device with a pivotal handle useful as a lever when perpendicular to the axis of the screwdriver blade. A variation of this theme in U.S. Pat. No. 4,170,909 includes an apparent point of novelty as being a female output drive and having a handle pivotable through 180°.

A simply constructed invention, but one of limited use and non-ratcheted, is disclosed in U.S. Pat. No. 3,773,094 for an angularly adjustable handle for a screwdriver blade. The handle is lockably pivotable at the upper end of the screwdriver blade at a pivot point removed from the end of the handle so as to form somewhat of a "T" when positioned perpendicularly to that shaft.

Finally, prior art includes several inventions which have multi-function handles perpendicularly disposed to either a tool bit or blade or to a ratchet drive which itself includes an output shaft. An early disclosure is found in U.S. Pat. No. 1,000,051 for a non-ratchetable screwdriver having a normal shape for use and a split handle, which halves may be pivoted away from one another to form an opposing "T" lever for added torque. U.S. Pat. No. 3,342,229 is for a ratchet handle screwdriver which includes a main handle portion fixed in coaxial alignment with ratchet and screwdriver shank. The main handle includes a fold-out handle portion pivoted adjacent the ratchet housing, which stops perpendicular to and radially extending from the main handle for leverage. When folded in alignment with the main handle, the fold-out handle portion completes the manually grippable cross section of the main handle. The combination handle for screwdrivers in U.S. Pat. No. 3,863,693 is very similar in structure and function to that in a previous patent, except that it includes no ratchet means. A third U.S. Pat. No. 4,235,269 is also similar in structure and function to U.S. Pat. No. 3,863,693, including reversible ratchet means, and also including a storage groove in the handle having a magnet therein for releasably storing extra tool bits or tips. Inter alia, this last group of inventions include space and/or functional limitations as a result of the handle shape and provide limited torque applying benefits to primarily a screwdriver-type tool blade.

The present invention provides a multi-function reversible, and preferably, lockable ratchet tool having an output shaft for use with coupleable socket means of various sizes. The two-part handle may be used coaxially with the axis of the ratchet and output drive shaft, pivotally split to have one portion radially extending for increased leverage, or pivoted in its entirety into a perpendicular orientation to the ratchet head for maximum torque in minimum vertical spacial work space requirements. This versatility provides a simple tool which will accept either female hexagon sockets or screwdriver blade sockets of any size while also easily adapting to one of two increased torque configurations and space limitations around the work area, which space limitations may only allow for using either an elongated-shaped tool or a short tool where there is sufficient adjacent space for a ratchet handle radially disposed.

BRIEF SUMMARY OF THE INVENTION

The present invention is a multiple-function and positioned ratchet tool which includes a releasable, and preferably, lockable ratchet head which has an output shaft adapted to matably insert into sockets, tool bits, or the like. A multi-position handle is also included having two mating handle portions which, together, form an elongated cylindrical handle for manual gripping. The main handle is pivotally connected to the ratchet head and may include locking means therebetween to rigidly, yet releasably maintain coaxial and/or parallel alignment to the ratchet head axis. The auxiliary handle is pivotally mounted either to the ratchet head or, along the length of the main handle, and may be pivoted separately away from the main handle to form a right-angle lever for increased torque. However, the entire handle assembly, including both main and auxiliary handle portions, mated together, may be released and pivoted to a position perpendicular to the ratchet head axis and held thusly, serving as a radially extending arm for added torque. The ratchet head may include mean for locking the output shaft so that torque may be translated directly in both rotational directions, absent the ratcheting feature.

It is therefore an object of this invention to provide a multi-use reversible ratchet tool which includes a two-part handle having at least three main operating positions in relation to the ratchet axis, for increased torque capacity and/or accommodating a wide variety of work space requirements.

It is another object to provide the above invention having a ratchet output shaft adapted to be releasably inserted into a wide variety of female sockets, tool bits, or the like.

It is yet another object to provide the above invention with a ratchet head which is not only reversible, but also lockable.

In accordance with these and other objects which will become apparent hereinafter, the instant invention will now be described with reference to the accompanying drawings in which:

DETAILED DESCRIPTION OF THE PREFERRED EMBODIMENT

Figure 1:
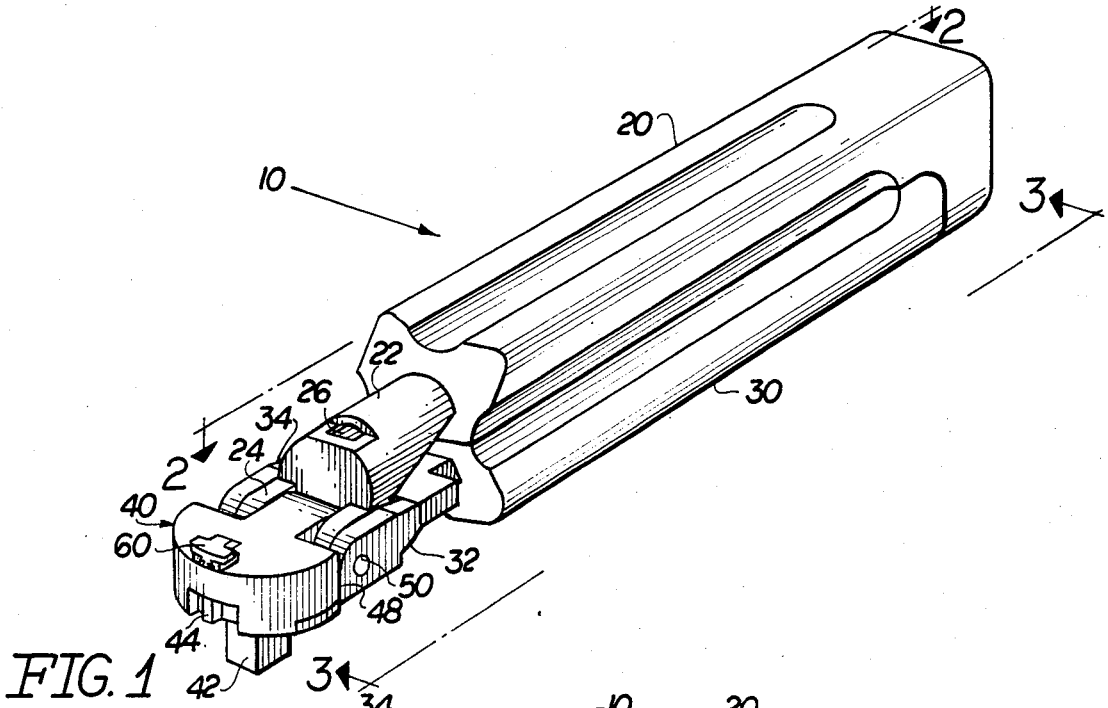
FIG. 1 is a perspective view of the preferred embodiment of the invention.
Figure 2:
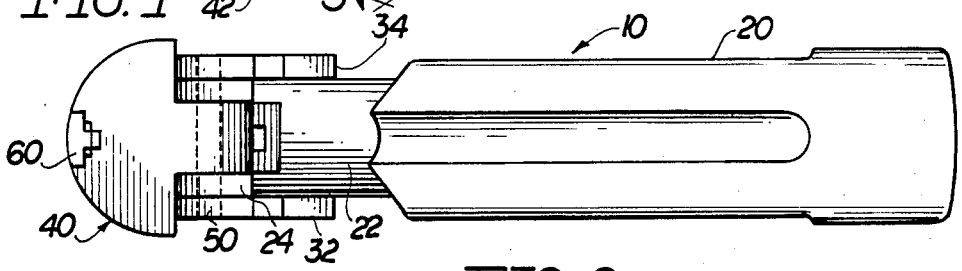
FIG. 2 is a top plan view of the preferred embodiment of the invention in the direction of arrows 2—2 in FIG. 1.

Referring now to the drawings, and particularly to FIGS. 1 through 4, the preferred embodiment of the invention is shown generally at 10 and incudes a main handle portion 20 and an auxiliary handle portion 30. These handle portions 20 and 30 are matably adapted to form a preferably cylindrical handle assembly as shown for manual gripping. The handle portions 20 and 30 are pivotally connected to ratchet head 40 by pin 50 therethrough.

The main handle portion 20 includes locking portion 22 and clevis portion 24 which mates around the ratchet head 40 as shown. The auxiliary handle portion 30 includes a clevis formed by two rigid extensions 32 and 34 which are spaced apart in the end of the auxiliary handle portion 30 so as to mate around clevis portion 24. Pin 50, forceably urged into aligned mating holes in the ratchet head 40, clevis 24, and rigid extensions 32 and 34, retains these components for pivotal and locked relationship for use as described herebelow.

Figure 3:
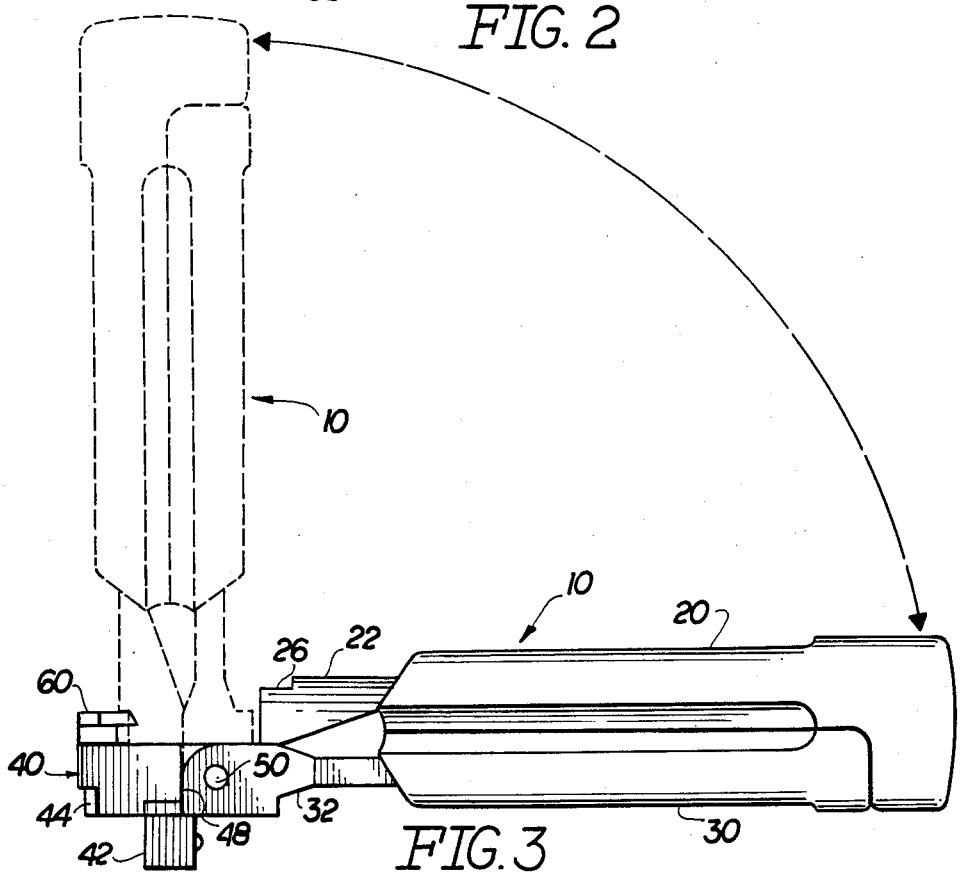
FIG. 3 is a side elevation view of the preferred embodiment of the invention in the direction of arrows 3—3 in FIG. 1 and showing the pivoting movement of the entire handle assembly.
Figure 4:
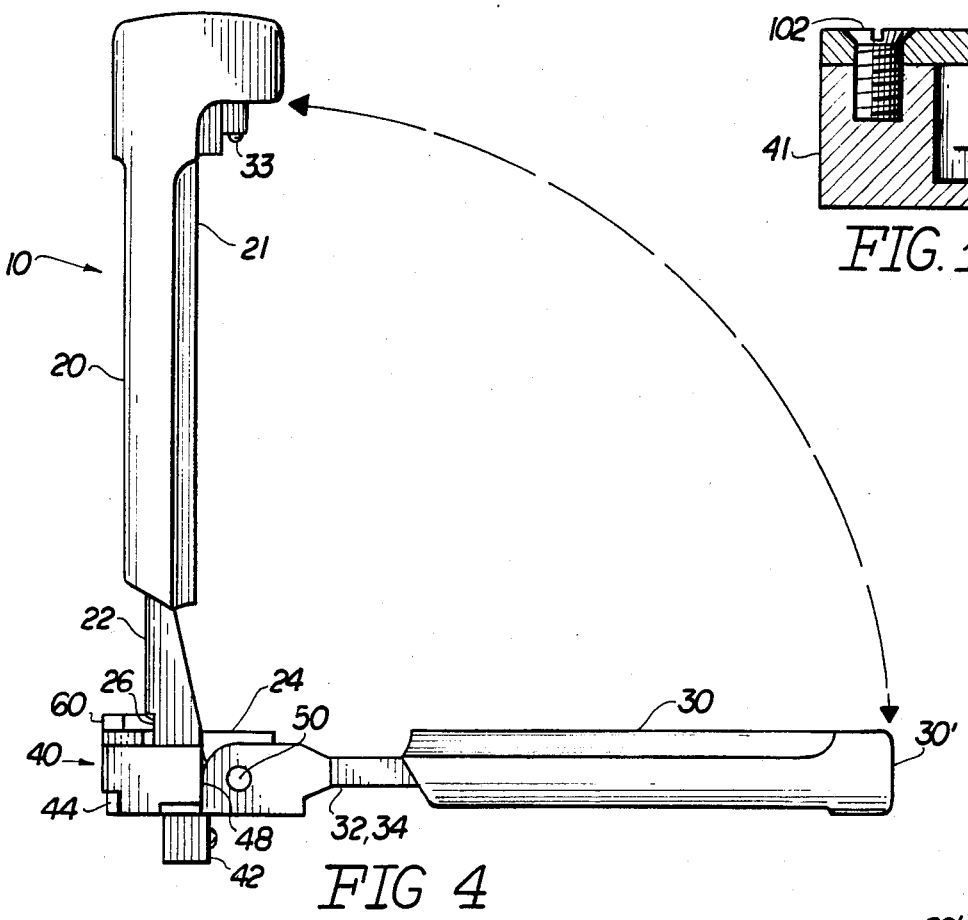
FIG. 4 is a side elevation view of the preferred embodiment of the invention similar to FIG. 3 except showing the pivoting movement of only the auxiliary handle portion.
Figure 14:
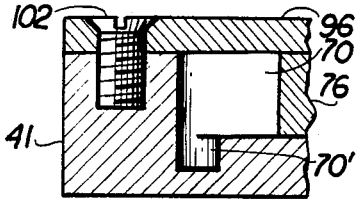

As best seen in FIGS. 3 and 4, the two handle portions 20 and 30 have three primary arrangements therebetween and in relation to the ratchet head 40 for use. As shown in phantom in FIG. 3, both handle portions 20 and 30 may be mated together and aligned with the axis of the ratchet head 40. In this configuration, the invention is useful similar to a screwdriver. As also seen in FIG. 3, the mated handle portions 20 and 30 may be pivoted together in the direction of the arrows to a perpendicular relation to the ratchet head axis. Surface 48, acting against the square corners of clevis 24 and rigid extensions 32 an 34, insures proper positioning of both handle portions 20 and 30 when perpendicular. In this configuration, the invention functions similar to a conventional ratchet handle. A third configuration for use is shown in FIG. 4 wherein the auxiliary handle portion 30 is pivoted away from the aligned main handle portion 20 to a perpendicular relation to both ratchet head axis and main handle portion 20. Surface 48 of the ratchet head 40 again insures proper perpendicular positioning. This configuration provides increased leverage, while also affording more stable alignment of output shaft axis by gripping and stabilizing the main handle portion 20. The enlarged distal end of the main handle portion 20 provides an enlarged surface for aplying maximum axial work engaging pressure as with the palm of the user's hand. The lower surface of the ratchet head 40 defines both a work and tool engaging surface, depending upon application. Note that the configuration of the proximal ends of both main and auxiliary handle portions 20 and 30 enable the axis of pin 50 to be positioned perpendicular to the axis of the output shaft 42 and in close proximity to the above-described work surface. This close positioning minimizes the work disengaging moment created by useful torque applied to the distal end of either the main handle as in FIG. 3 or the auxiliary handle 30 as in FIG. 4.

The ratchet head 40 includes a square section output shaft 42 having a conventional spring 88 and ball 86 arrangement (see FIG. 10), for retaining mating female sockets and tool bits, and also includes latch 60 and pawl adjuster 44. However, the output shaft could be a female member or the like and be fully within the intended scope of this invention. The latch 60 is held for slidable lateral translation and serves to matably engage into notch 26 to lock the main handle portion 20 in alignment with the ratchet head axis. Embedded in the inside main handle contour 21 is a conventional spring-loaded ball detent retainer which houses a detent ball 33 which interengages with a mating pocket in the distal end of the auxiliary handle portion 30 similar to that shown in FIG. 9, described hereafter, to releasably retain the auxiliary handle portion 30 mated against and aligned with the main handle portion 20.

Referring now to FIGS. 5, 6, 9, and 13, the first alternate embodiment is shown generally at 10' and also includes a main handle portion 20' and auxiliary handle portion 30'. In this embodiment, the main handle portion 20' is pivotally connected to the ratchet head 40 by two shorter aligned pins 50'. However, the auxiliary handle portion 30' is pivotally connected by two pins 52 to "H"-shaped double clevis 24' which is rigidly connected or made a part of the main handle portion 20' by locking portion 22'. When the main handle portion 20' is locked in aligned relation to the ratchet head axis, the auxiliary handle portion 30' may be pivoted in the direction of arrow C about the axis of pins 52 shown in phantom in FIG. 5. This places the auxiliary handle 30' in an elevated and slightly displaced perpendicular relationship to the ratchet head 40. The handle assembly of both main and auxiliary handle portions 20' and 30', mated, may also together be released and pivoted in the direction of arrow D to a perpendicular relationship to the ratchet head axis. This alternate 90° mode of operation provides the user with a choice of handle offset positioning in relation to the previously described work surface (lower surface of ratchet head 40). When the auxiliary handle 30' is pivoted about the axis of pins 52 at 90°, this offset is greater to accommodate peripheral obstructions. However, when the main and auxiliary handle portions 20' and 30' are used in side-by-side relation at 90° to the axis of the output shaft about pins 50', the offset is minimized and, thusly, the work disengaging moment is also minimized.

Figure 9:
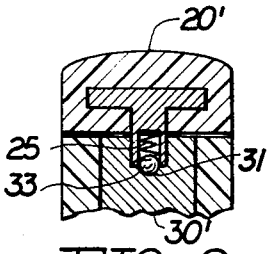
FIG. 9 is a section view of a portion of the first alternate embodiment of the invention in the direction of arrows 9—9 in FIG 5.

In FIG. 9 is shown a conventional ball detent means, including a ball 33 and spring 25 mounted in the main handle portion 20', which ball 33 releasably engages a matable pocket 31 in a distal end of the auxiliary handle 30'. By this means, the two handle portions are releasably retained mated together to form a convenient manual gripping handle assembly.

Figure 13:
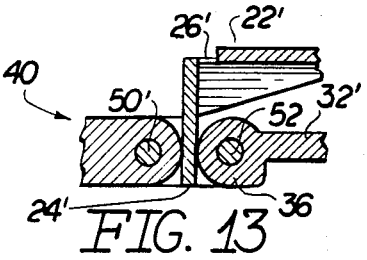
FIG. 13 is an elevation section view of a portion of the first alternate embodiment of the invention in the direction of arrows 13—13 in FIG. 6.
Figure 5:
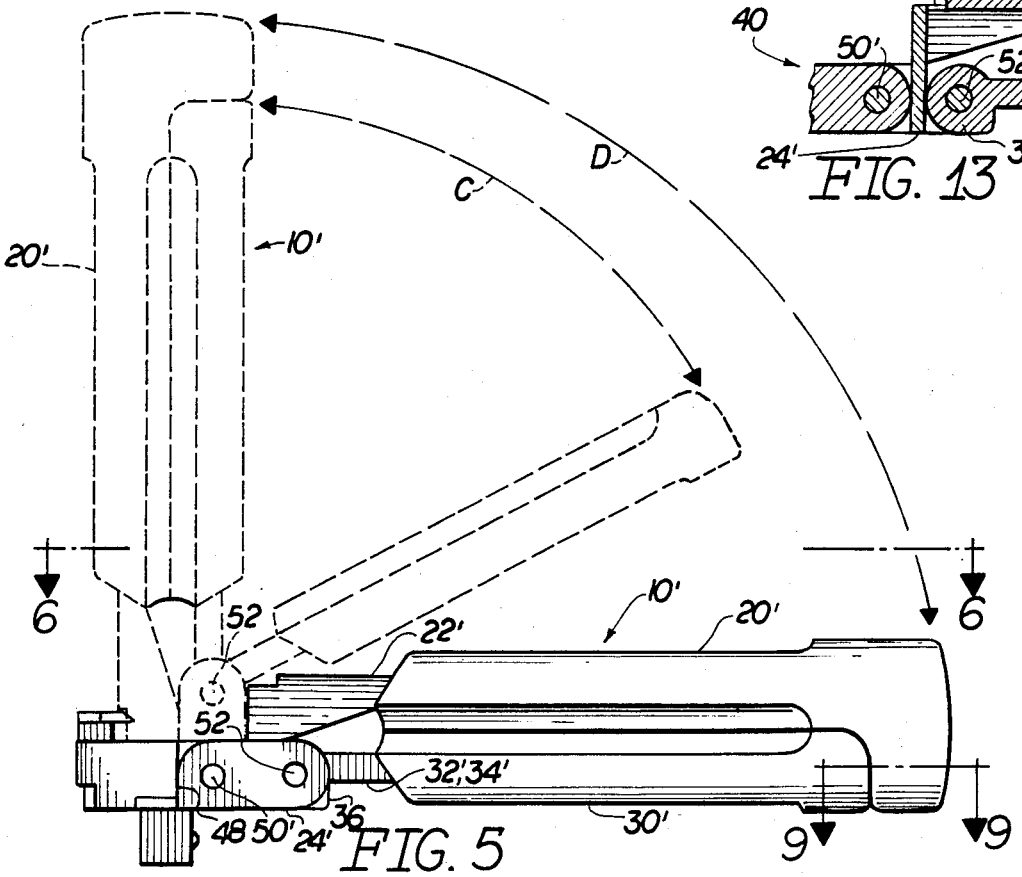
FIG. 5 is a side elevation view of the first alternate embodiment of the invention.
Figure 6:
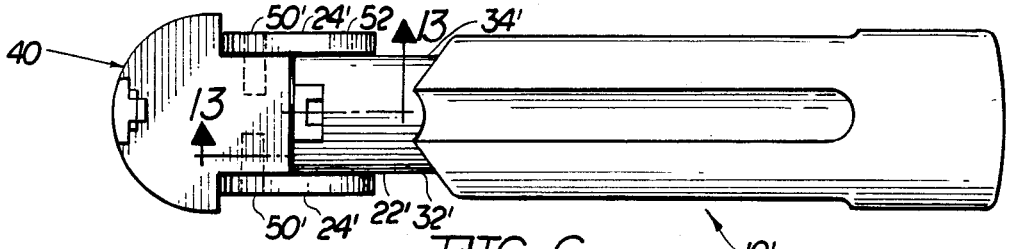
FIG. 6 is a top plan view of the first alternate embodiment of the invention in the direction of arrows 6—6 in FIG. 5.

FIG. 13 depicts the stop means for auxiliary handle portion 30'. Boss 36 is shaped to serve as a perpendicular stop against the center portion of clevis 24' when handle portions 20' and 30' are perpendicularly disposed to one another.

Figure 7:
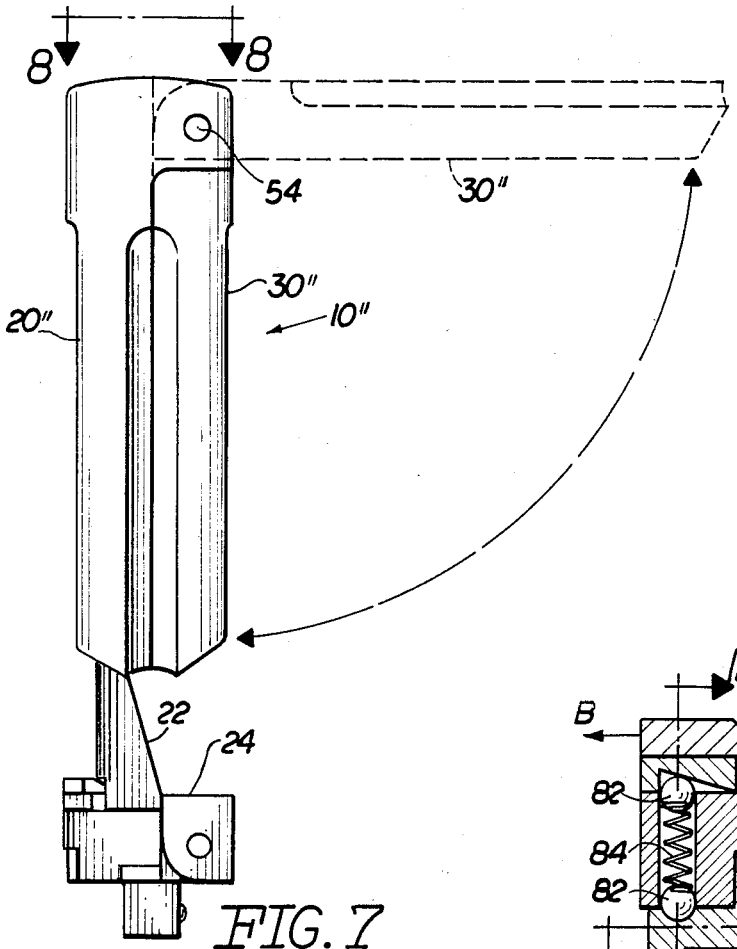
FIG. 7 is a side elevation view of the second alternate embodiment of the invention.
Figure 8:
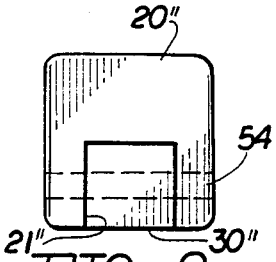
FIG. 8 is an end view of the second alternate embodiment of the invention in the direction of arrows 8—8 in FIG. 7.

Referring now to FIGS. 7 and 8, the second alternate embodiment is shown generally at 10'', and also includes a main handle portion 20'' and auxiliary handle portion 30''. However, in this arrangement, the two are pivotally connected at the distal end of the main handle portion 20'' by pin 54. U-shaped pocket 21'' in the main handle portion 20'' matably receives one end of the auxiliary handle portion 30'', supportably receiving pin 54 coaxially therethrough. The main handle portion 20'' is pivotally connected to the ratchet head 40 by locking portion 22 and clevis 24 as previously described. Auxiliary handle 30'' may then be positioned matably aligned against the main handle portion 20'' or pivoted in the direction of the arrow perpendicular for increased leverage. Note that the position of the pivotal axis, pin 54, could be anywhere along the length of the main handle portion 20''.

Figure 10:
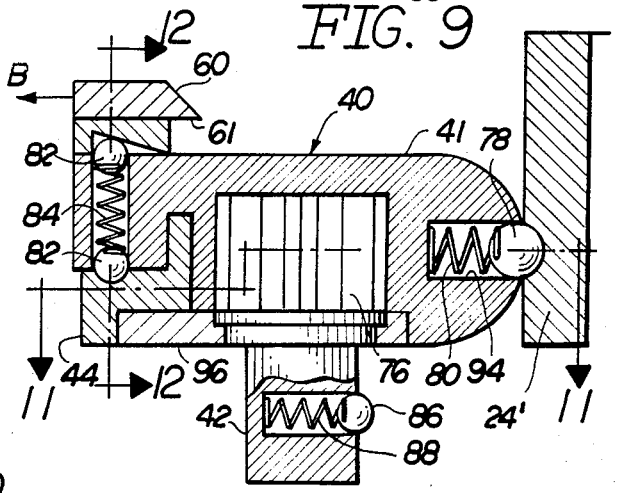
FIG. 10 is an elevation section view of a portion of the first alternate embodiment of the invention along a portion of the centerline axis in FIG. 6 and also in the direction of arrows 10—10 in FIG. 11.
Figure 11:
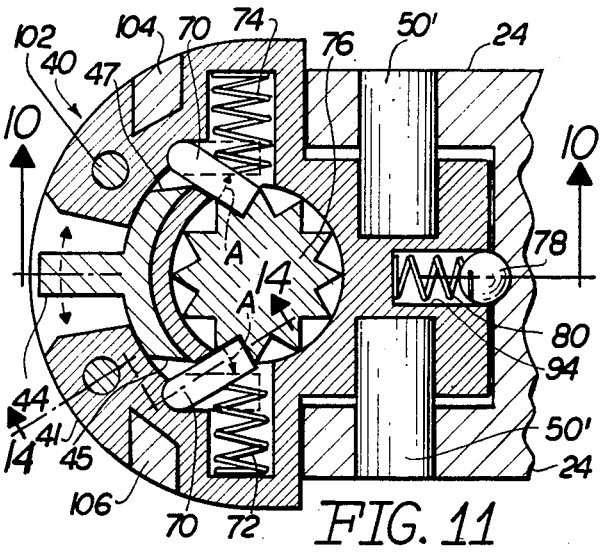
FIG. 11 is a top section view of a portion of the first alternate embodiment of the invention in the direction of arrows 11—11 in FIG. 10.

Referring now to FIGS. 10, 11, 12, and 14, the ratchet head 40 includes a main housing 41 having a cavity to supportably receive the ratchet 76 and integral output shaft 42 held for rotation therein, and locked within the main housing by cover plate 96 which is held in relation to the main housing 41 by threaded fasteners 102. In FIG. 11, pawls 70 are pivotally mounted in the main housing 41 by pawl portions 70', their position pivotally controlled by springs 72 and 74 and by the angular positioning of pawl adjuster 44 at 45 and 47. When the pawl adjuster 44 is in the position shown, the ratchet 76 and output shaft 42 are locked so that any rotational motion to the ratchet head by the handle portions in either direction of rotation will result in direct translation to the output shaft 42. Movement of the pawl adjuster 44 in either direction pivots one of the pawls 70 in the direction of arrow A against spring 72 or 74 to disengage that pawl 70 from the ratchet 76. The ratchet 76 will then rotate relatively freely in one direction only.

Detent ball 78, urged by spring 80, serves as a position detent for clevis 24 and connected main handle portion 20' when positioned perpendicular to the ratchet head 40.

Figure 12:
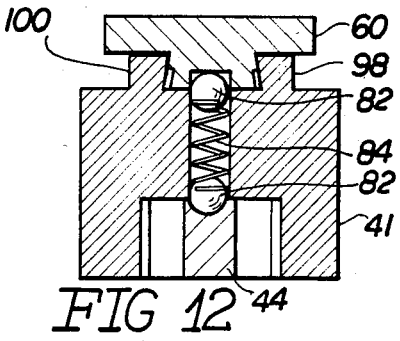
FIG. 12 is an elevation section view of a portion of the first alternate embodiment of the invention in the direction of arrows 12—12 in FIG. 10.

As best seen in FIGS. 10 and 12, latch 60 is slidable in the direction of arrow B in groove members 98 and 100 to release the locking portion 22' to allow pivoting of the main handle portion 20'. Spring 84 and upper ball 82 return the latch 60 to a locking position when released. A lower ball 82 cooperates with a mating pocket in the pawl adjuster 44 to serve as a detent in the "ratchet-locked" position. Although not shown, groove members 98 and 100 and latch 60 are also matably shaped so as to limit the travel of the latch 60 in the direction of arrow B, and when latch 60 is released, to stop its travel as urged by spring 82 and upper ball 82 at the position shown in FIG. 10.

Anti-shift lugs 104 and 106, integrally formed with the main housing 41, mate into pockets formed into the margin of the cover plate 96. By this means, lateral force applied to the ratchet head 40 during heavy use, particularly where used as a conventional ratchet handle, is translated, not to the weaker threaded fasteners 102 by cover plate 96, but rather to the stronger anti-shift lugs 104 and 106.

Although not shown because of minuteness, it is to be understood that all spring and ball detents are retained in their supporting cavities by crimping the ends of those cavities slightly so that the ball, once installed, will not pop back out.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A multi-function ratchet tool comprising:

a ratchet head having a reversible output shaft for use, the axis of said output shaft generally perpendicular to the lower surface of said ratchet head;

said lower surface defining a tool and work engaging surface;

an elongated generally cylindrical handle having main and auxiliary handle portions;

said main and auxiliary handle portions each having a distal end and a proximal end and a shank therebetween;

said distal end of said main handle portion enlarged relative to said main handle portion shank and proximal end;

said auxiliary handle portion adapted to mate in side-by-side relation against said shank of said main handle portion forming said handle such that said distal end of said auxiliary handle portion is adjacent and within said enlarged distal end of said main handle portion;

said main handle portion pivotally connected at its proximal end to said ratchet head, the axis of said pivotal connection between said main handle portion proximal end and said ratchet head perpendicular to, and laterally displaced from, said output shaft axis and positioned generally parallel to, and in close proximity to, said lower surface;

said auxiliary handle portion pivotally connected at its proximal end to said ratchet head coaxially with said pivotal connection between said main handle portion proximal end and said ratchet head;

first releasable locking means between said auxiliary handle portion and said main handle portion for retaining said auxiliary handle portion against said shank of said main handle portion;

second releasable locking means between said ratchet head and said main handle portion for retaining said main handle portion in parallel relation to said axis of said output shaft;

first stop means for limiting the pivoting of said auxiliary handle portion to a maximum of about 90° in relation to said output shaft axis and said main handle portion;

second stop means for limiting the pivoting of said handle to a maximum of about 90° in relation to said output shaft axis.

2. A multi-function ratchet tool as set forth in claim 1, further comprising:

releasable detent means between said handle and said ratchet head for maintaining a generally perpendicular orientation therebetween.

3. A multi-function ratchet tool as set forth in claim 1, wherein:

said reversible ratchet head is also lockable.

4. A multi-function ratchet tool as set forth in claim 1, wherein:

said output shaft is adapted to matably, releasably receive sockets and tool bits.

5. A multi-function ratchet tool comprising:

a ratchet head having a reversible output shaft for use, the axis of said output shaft generally perpendicular to the lower surface of said ratchet head;

said lower surface defining a tool and work engaging surface;

an elongated generally cylindrical handle having main and auxiliary handle portions;

said main and auxiliary handle portions each having a distal end and a proximal end and a shank therebetween;

said distal end of said main handle portion enlarged relative to said main handle portion shank and proximal end;

said auxiliary handle portion adapted to mate in side-by-side relation against said shank of said main handle portion forming said handle such that said distal end of said auxiliary handle portion is against and within said enlarged distal end of said main handle portion;

said main handle portion pivotally connected at its proximal end to said ratchet head, the axis of said pivotal connection between said main handle portion proximal end and said ratchet head perpendicular to, and laterally displaced from, said output shaft axis and positioned generally parallel to, and in close proximity to, said lower surface;

said auxiliary handle portion pivotally connected at its proximal end to said main handle portion, the axis of said pivotal connection between said auxiliary handle portion proximal end and said main handle portion perpendicular to said output shaft axis and positioned generally parallel to, and farther away from, said lower surface than said pivotal connection between said main handle portion proximal end and said ratchet head;

first releasable locking means between said auxiliary handle portion and said main handle portion for retaining said auxiliary handle portion against said shank of said main handle portion;

second releasable locking means between said ratchet head and said main handle portion for retaining said main handle portion in parallel relation to said axis of said output shaft;

first stop means for limiting the pivoting of said auxiliary handle portion to a maximum of about 90° in relation to said output shaft axis and said main handle portion;

second stop means for limiting the pivoting of said handle to a maximum of about 90° in relation to said output shaft axis.

6. A multi-function ratchet tool as set forth in claim 5, further comprising:

releasable detent means between said handle and said ratchet head for maintaining a generally perpendicular orientation therebetween.

7. A multi-function ratchet tool as set forth in claim 5, wherein:

said reversible ratchet head is also lockable.

8. A multi-function ratchet tool as set forth in claim 5, wherein:

said output shaft is adapted to matably, releasably receive sockets and tool bits.

9. A ratchet head having a reversible output shaft for use, the axis of said output shaft generally perpendicular to the lower surface of said ratchet head;

said lower surface defining a tool and working engaging surface;

an elongated generally cylindrical handle having main and auxiliary handle portions;

said main and auxiliary handle portions each having a distal and a proximal end and a shank therebetween;

said distal end of said main handle portion enlarged relative to said main handle portion shank and proximal end;

said auxiliary handle portion adapted to mate in side-by-side relation against said shank of said main handle portion forming said handle such that said distal end of said auxiliary handle portion is adjacent and within said enlarged distal end of said main handle portion;

said main handle portion pivotally connected at its proximal end to said ratchet head, the axis of said pivotal connection between said main handle portion proximal end and said ratchet head perpendicular to, and laterally displaced from, said output shaft axis and positioned generally parallel to, and in close proximity to, said lower surface;

said auxiliary handle portion pivotally connected at its distal end to said enlarged distal end of said main handle portion, the axis of said pivotal connection between said auxiliary handle portion distal end and said main handle portion enlarged distal end parallel to said axis of said pivotal connection between said main handle portion proximal end and said ratchet head;

first releasable locking means between said auxiliary handle portion and said main handle portion for retaining said auxiliary handle portion in said shank of said main handle portion;

second releasable locking means between said ratchet head and said main handle portion for retaining said main handle portion in parallel relation to said axis of said output shaft;

first stop means for limiting the pivoting of said auxiliary handle portion to a maximum of about 90° in relation to said output shaft axis and said main handle portion;

second stop means for limiting the pivoting of said handle to a maximum of about 90° in relation to said output shaft axis.

10. A multi-function ratchet tool as set forth in claim 9, further comprising:

releasable detent means between said handle and said ratchet head for maintaining a perpendicular orientation therebetween.

11. A multi-function ratchet tool as set forth in claim 9, wherein:

said reversible ratchet head is also lockable.

12. A multi-function ratchet tool as set forth in claim 9, wherein:

said output shaft is adapted to matably, releasably receive sockets and tool bits.

* * * * *